US006394232B1

(12) United States Patent
Iwata et al.

(10) Patent No.: US 6,394,232 B1
(45) Date of Patent: May 28, 2002

(54) METHOD AND APPARATUS FOR CONTROL OF A GROUP OF ELEVATORS BASED ON ORIGIN FLOOR AND DESTINATION FLOOR MATRIX

(75) Inventors: Masafumi Iwata; Koichi Sasakawa, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/694,366

(22) Filed: Oct. 24, 2000

(30) Foreign Application Priority Data

Apr. 28, 2000 (JP) ..... 2000-130435

(51) Int. Cl.[7] ..... B66B 1/18
(52) U.S. Cl. ..... 187/382; 187/247
(58) Field of Search ..... 187/380, 382, 187/383, 385, 387, 247, 391

(56) References Cited

U.S. PATENT DOCUMENTS 4,846,311 A 7/1989 Thangavelu ..... 187/125
4,947,965 A * 8/1990 Kuzunuki et al. ..... 187/127
5,409,085 A * 4/1995 Fujino et al. ..... 187/380
5,459,665 A * 10/1995 Hikita et al. ..... 364/437
5,503,249 A * 4/1996 Virtamo et al. ..... 187/382
5,612,519 A * 3/1997 Chenais ..... 187/382
5,719,360 A * 2/1998 Davis et al. ..... 187/383
5,883,343 A * 3/1999 MacDonald et al. ..... 187/383
5,955,708 A * 9/1999 Amano et al. ..... 187/247
6,065,570 A * 5/2000 Friedli et al. ..... 187/387

FOREIGN PATENT DOCUMENTS

JP 2-43188 1/1990

* cited by examiner

*Primary Examiner*—Jonathan Salata
(74) *Attorney, Agent, or Firm*—Leydig, Voit & Mayer, Ltd.

(57) ABSTRACT

An optimal control method and system of a group of elevator cars is provided. A matrix of origin halls and destination halls is used. In this matrix, each element is referred to as a mission unit. Also, mission groups are defined. Each of the mission groups has one or more mission units and is serviceable by one of the elevator cars. Further, a mission group set is defined as a set of the mission groups provided for the group of elevator cars. Then, the mission groups are dynamically allocated to the group of elevator cars, which produces effective traffic control of the elevator cars.

10 Claims, 12 Drawing Sheets

*Fig.2*

OD MAP

DESTINATION FLOORS

ORIGINAL FLOORS

| | 1F | 2F | 3F | 4F | 5F | 6F | 7F | 8F | 9F | 10F | 11F |
|---|---|---|---|---|---|---|---|---|---|---|---|
| 1F | | od(1,2) | od(1,3) | od(1,4) | od(1,5) | od(1,6) | od(1,7) | od(1,8) | od(1,9) | od(1,10) | od(1,11) |
| 2F | od(2,1) | | od(2,3) | od(2,4) | od(2,5) | od(2,6) | od(2,7) | od(2,8) | od(2,9) | od(2,10) | od(2,11) |
| 3F | od(3,1) | od(3,2) | | od(3,4) | od(3,5) | od(3,6) | od(3,7) | od(3,8) | od(3,9) | od(3,10) | od(3,11) |
| 4F | od(4,1) | od(4,2) | od(4,3) | | od(4,5) | od(4,6) | od(4,7) | od(4,8) | od(4,9) | od(4,10) | od(4,11) |
| 5F | od(5,1) | od(5,2) | od(5,3) | od(5,4) | | od(5,6) | od(5,7) | od(5,8) | od(5,9) | od(5,10) | od(5,11) |
| 6F | od(6,1) | od(6,2) | od(6,3) | od(6,4) | od(6,5) | | od(6,7) | od(6,8) | od(6,9) | od(6,10) | od(6,11) |
| 7F | od(7,1) | od(7,2) | od(7,3) | od(7,4) | od(7,5) | od(7,6) | | od(7,8) | od(7,9) | od(7,10) | od(7,11) |
| 8F | od(8,1) | od(8,2) | od(8,3) | od(8,4) | od(8,9) | od(8,6) | od(8,7) | | od(8,9) | od(8,10) | od(8,11) |
| 9F | od(9,1) | od(9,2) | od(9,3) | od(9,4) | od(9,5) | od(9,6) | od(9,7) | od(9,8) | | od(9,10) | od(9,11) |
| 10F | od(10,1) | od(10,2) | od(10,3) | od(10,4) | od(10,5) | od(10,6) | od(10,7) | od(10,8) | od(10,9) | | od(10,11) |
| 11F | od(11,1) | od(11,2) | od(11,3) | od(11,4) | od(11,5) | od(11,6) | od(11,7) | od(11,8) | od(11,9) | od(11,10) | |

Fig.3

MISSION MAP

DESTINATION FLOORS

ORIGINAL FLOORS

| | 1F | 2F | 3F | 4F | 5F | 6F | 7F | 8F | 9F | 10F | 11F |
|---|---|---|---|---|---|---|---|---|---|---|---|
| 1F | | dm(1,2) | dm(1,3) | dm(1,4) | dm(1,5) | dm(1,6) | dm(1,7) | dm(1,8) | dm(1,9) | dm(1,10) | dm(1,11) |
| 2F | dm(2,1) | | dm(2,3) | dm(2,4) | dm(2,5) | dm(2,6) | dm(2,7) | dm(2,8) | dm(2,9) | dm(2,10) | dm(2,11) |
| 3F | dm(3,1) | dm(3,2) | | dm(3,4) | dm(3,5) | dm(3,6) | dm(3,7) | dm(3,8) | dm(3,9) | dm(3,10) | dm(3,11) |
| 4F | dm(4,1) | dm(4,2) | dm(4,3) | | dm(4,5) | dm(4,6) | dm(4,7) | dm(4,8) | dm(4,9) | dm(4,10) | dm(4,11) |
| 5F | dm(5,1) | dm(5,2) | dm(5,3) | dm(5,4) | | dm(5,6) | dm(5,7) | dm(5,8) | dm(5,9) | dm(5,10) | dm(5,11) |
| 6F | dm(6,1) | dm(6,2) | dm(6,3) | dm(6,4) | dm(6,5) | | dm(6,7) | dm(6,8) | dm(6,9) | dm(6,10) | dm(6,11) |
| 7F | dm(7,1) | dm(7,2) | dm(7,3) | dm(7,4) | dm(7,5) | dm(7,6) | | dm(7,8) | dm(7,9) | dm(7,10) | dm(7,11) |
| 8F | dm(8,1) | dm(8,2) | dm(8,3) | dm(8,4) | dm(8,9) | dm(8,6) | dm(8,7) | | dm(8,9) | dm(8,10) | dm(8,11) |
| 9F | dm(9,1) | dm(9,2) | dm(9,3) | dm(9,4) | dm(9,5) | dm(9,6) | dm(9,7) | dm(9,8) | | dm(9,10) | dm(9,11) |
| 10F | dm(10,1) | dm(10,2) | dm(10,3) | dm(10,4) | dm(10,5) | dm(10,6) | dm(10,7) | dm(10,8) | dm(10,9) | | dm(10,11) |
| 11F | dm(11,1) | dm(11,2) | dm(11,3) | dm(11,4) | dm(11,5) | dm(11,6) | dm(11,7) | dm(11,8) | dm(11,9) | dm(11,10) | |

MISSION GROUP SET

MISSION GROUP 1

MISSION GROUP 2

MISSION GROUP 3

MISSION GROUP 4

■ dmk(i,j) = 1

□ dmk(i,j) = 0

METHOD AND APPARATUS FOR CONTROL OF A GROUP OF ELEVATORS BASED ON ORIGIN FLOOR AND DESTINATION FLOOR MATRIX

FIELD OF THE INVENTION

The present invention relates to an optimal control method and apparatus for an elevator system having a plurality of elevator cars and, more particularly, to an optimal elevator control method and apparatus for controlling the elevator cars effectively.

BACKGROUND OF THE INVENTION

In general, an optimal elevator control system for controlling a plurality of elevator cars is designed to realize effective travel of the elevator cars and thereby to provide improved transportation service in a building in which such elevator cars are located. For this purpose, when a hall call has been made by the passenger at a certain hall in the building, the control system performs a call allocation in which one elevator car is allocated in response to the hall call so that the most effective service would be attained in the building.

However, the call allocation itself is unable to make a precise prediction of the future hall calls to be made by the passengers. The call allocation has been designed to increase the transportation capacity in combination with a traffic control rule preferably used for a traffic-flow control system. The control process in which a suitable traffic control rule is determined according to the current traffic-flow for the control of the elevator cars is referred to as "pattern operation" hereinafter.

According to the pattern operation, during morning rush hours in which heavy traffic occurs, service halls where the elevator service is available for the passengers are divided into several zones. Also, one or more elevator cars are allocated to the hall or halls grouped in one zone. The passenger waiting at the main hall is allocated to the zone including the hall where the passenger intends to go. Indeed, this operation (referred to as "zoning operation" or "grouping operation") can increase the efficiency of the transportation. One example of the zoning operation is disclosed in the Japanese Patent Unexamined Laid-Open Publication No. 2-43188.

The conventional operations designed to divide the halls into several zones or groups are effective to control a relatively simple traffic-flow which would occur in the morning rush-hour. However, such operations are less effective for other complicated traffic-flows. Also, among others, only the zoning operation is useful for the specific type of traffic and its analogues. Further, in order to control a variety of traffic patterns, an independent zoning or allocation rule should be heuristically generated for each of the traffic patterns. However, the automatic generation of such rules can considerably be difficult.

SUMMARY OF THE INVENTION

To overcome these problems, in a method and system for an optimal control of a group of elevator cars according to the present invention, a transportation work assigned to each elevator car comprises at least one work unit (referred to as "mission unit" hereinafter) of a transportation from one departure (origin) floor to another destination floor. The mission units are assigned to a plurality of work groups (referred to as "mission groups" hereinafter). Then, the mission groups are dynamically allocated to the elevator cars. This allows to increase a transportation ability and efficiency for various traffic flows. Also, this allows to provide a general zoning operation. Further, an automatic generation of work rules, i.e., mission groups, capable of increasing the transportation ability and efficiency can be done in the combination of an optimal technique.

BRIEF DESCRIPTION OF THE DRAWINGS

FIG. 2 is a diagram showing an origin and destination map (i.e., OD map) in the form of a matrix;

FIG. 3 is a diagram showing a map of mission units in the form of a matrix;

DETAILED DESCRIPTION OF THE PREFERRED EMBODIMENTS

With reference to the drawings, several embodiments of the optimal control method and apparatus for controlling a group of elevator cars, according to the present invention will be described in detail hereinafter.

First Embodiment

The method and apparatus for the optimal control of a group of elevator cars according to the present invention employs unique concepts such as "mission unit", "mission group" (M.G.) and "mission group set" (M.G.S.) which would be described in detail below, based on which specific traffic control plans are organized.

The "mission unit" represents an operation unit for one elevator car to transport one or more passengers from one origin or departure floor to another destination floor. The mission unit is an element of matrix that is a combination of several origin and destination floors for one elevator car (see FIG. 3).

The "mission group" represents a composition of plural mission units that are serviceable using one elevator car. Also, the mission groups are indicated in the matrix of origin and destination halls for one elevator car in the form of plural gatherings or groups each having one or more mission units and allocated to the elevator car (see FIGS. 4A–4D).

The "mission group set" represents a set of mission groups that are serviceable by the plural elevator cars in the system.

Generally, in the optimal control method and system for the group of elevator cars of the present invention, a plurality of mission groups and one mission group set including the mission groups is generated. Then, each of the mission groups in the mission group set is allocated dynamically to each elevator car. Finally, the elevator cars are controlled according to the allocated mission group.

Figure 1:
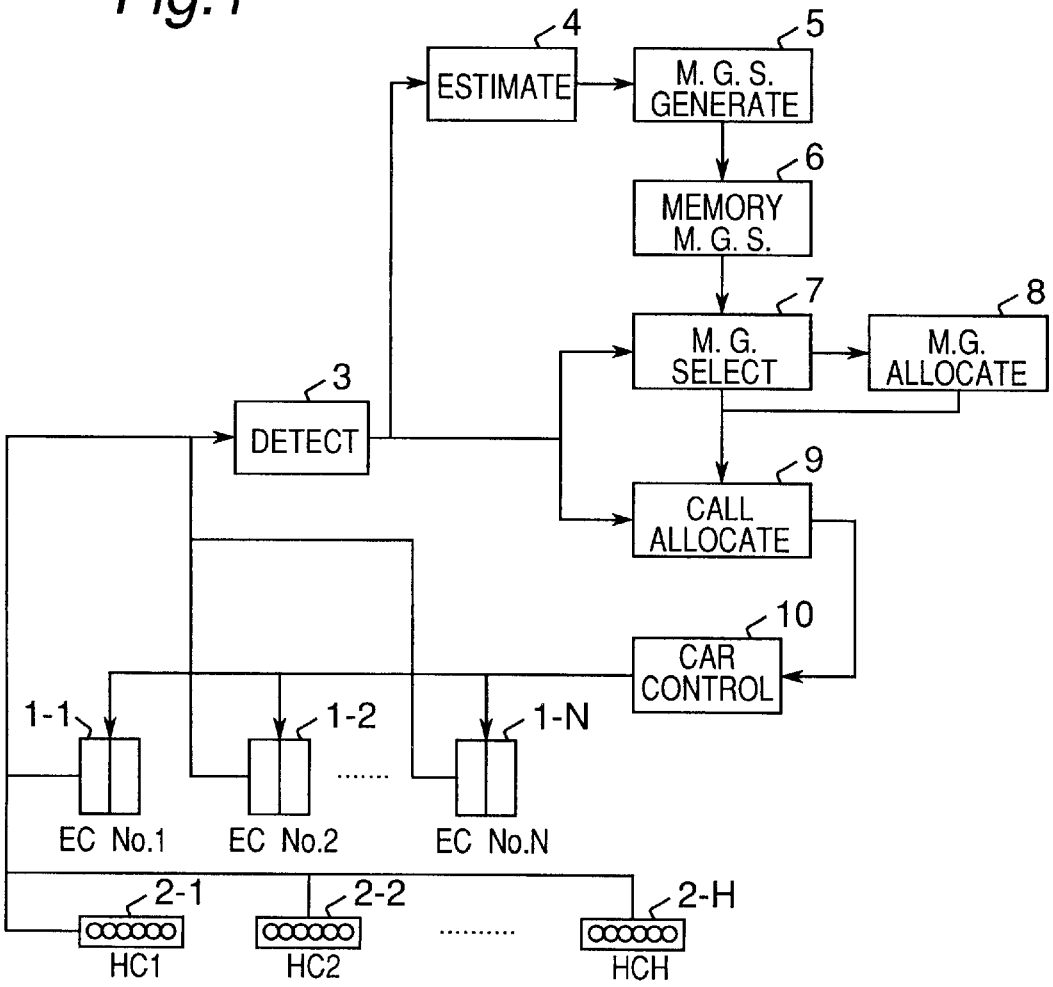
FIG. 1 is a schematic block diagram of an optimal control system according to the first embodiment of the present invention.
Figure 4A:
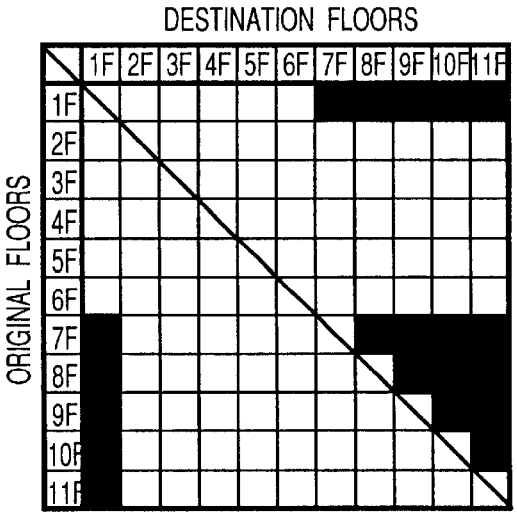
FIGS. 4A–4D are diagrams each showing mission groups.
Figure 4B:
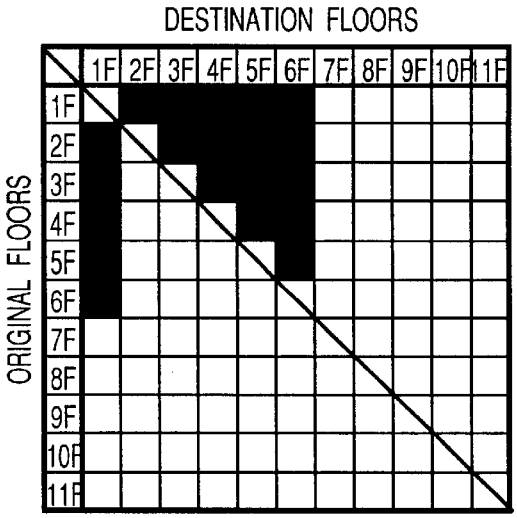
Figure 4C:
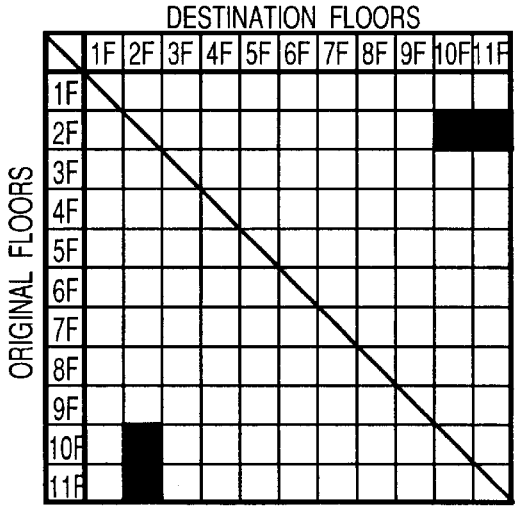
Figure 4D:
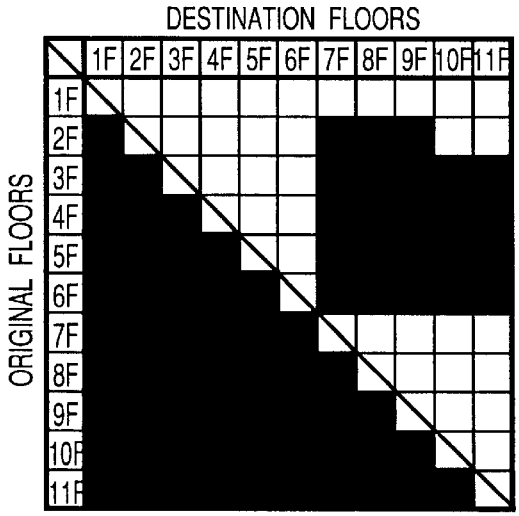

FIG. 1 illustrates a basic structure of the optimal control system of elevator cars according to the first embodiment. In this drawing, reference numerals (1-1) to (1-N) represent elevator units or elevator cars to be controlled by the system. Also, an alphabet (N) represents the number of elevator units or elevator cars. Reference numerals (2-1) to (2-H) [H: the number of floors] represent hall call devices by which the passengers can designate the destination halls. The hall call device, which includes plural call buttons for the designation of the destination floor numbers, is installed at a suitable place, e.g., typically in a wall near the elevator door, of the hall or hall. A detect block (3) detects a variety of information including the position, moving velocity, the number of passengers, call registration, call allocation, moving and door conditions for each of the elevator cars (1-1) to (1-N) and also detects signals transmitted from the hall call devices (2-1) to (2-H). An estimate block (4) estimates the current traffic-flow in the building with the elevator units (1-1) to (1-N) based upon information detected at the detect block (3). The traffic information estimated in the estimate block (4) is provided as an estimated traffic-flow data in the form of a passenger incidence (i.e., the number of passengers/time) and an origin-destination (OD) map. The OD map is provided in the form of matrix of elements each of which represents a traffic incident from one floor (origin or departure floor) to another (destination floor), as shown in FIG. 2. A mission group set generate block (5) generates a mission group set to be used for the traffic-flow, based upon the estimated traffic-flow data and information of the elevator cars. As described above, the mission group set is the set of mission groups to be used for controlling the traffic-flow. A mission group set memory block (6) memorizes the mission group set generated at the mission group set generate block (5). A mission group select block (7) selects one mission group serviceable to hall call or calls generated. A mission group allocate block (8) determines the elevator car to which a new mission group will be allocated if the elevator car has not been allocated with any mission group selected at the mission group select block (7). In response to an allocation of mission groups, a call allocate block (9) determines the elevator car to which the mission group has not been allocated and then provides an allocation command to a car control block (10). The car control (10) controls the elevator cars, display devices and so forth according to the call allocation. The display devices may include lamps provided at the hall and near the elevator door for the indication of upward and downward directions of the elevator car, or display panels indicate the series of the destination floors on the elevator car.

As described above, the optimal control system for controlling a group of elevator cars has various blocks such as mission group set generate block (5), mission group set memory block (6), mission group select block (7), mission group allocate block (8) and hall call allocate block (9). Each of the blocks as well as the mission group will be described in detail below.

The elevator is a major traffic means for the transportation of the passengers in the buildings with plural halls. For this purpose, the optimal control system controls the travels of the elevator cars (1-1) to (1-N) in response to a state of call generation made by the passengers. The state of call generation, which may be referred to as traffic flow, is indicated by the combination of the number of passengers generated in per unit time and the OD map. The OD map, as shown in FIG. 2, is the table in the form of matrix of elements each indicating a ratio of passengers who intends to move one floor (origin or departure floor) to another floor (destination floor). Specifically, in the drawing OD(i, j) is an element in the OD map or matrix that shows the ratio of passengers from (i)th floor to (j)th floor. As described above, a minimum unit of the traffic flow of the passengers is a travel from (i)th floor to (j)th floor. Accordingly, the travel from (i)th floor to (j)th floor can be deemed to as a minimum unit of the traffic of elevator cars for transporting passengers. Therefore, as described above a unit of the traffic allocated to one elevator car is referred to as "mission unit". The mission units are provided in the form of map shown in FIG. 3. If a number of elevator cars, corresponding to the number of mission units, are provided, each mission unit can be allocated to each elevator car. However, this is unreasonable. Instead, according to the present invention, a group of mission units (i.e., mission group) being allocated to one elevator car is generated by grouping several mission units together. Naturally, the mission groups are each generated according to the traffic-flow and the number of the elevator cars in order to maximize the transportation by the elevator cars. The generated mission groups are dynamically allocated to elevator cars in response to hall calls. Then, according to the mission group allocation, the elevator car that would be driven in response to the call is determined. As described above, the set of the generated mission groups is referred to as "mission group set". The mission group set can be represented in the form of plural matrixes shown in FIGS. 4A–4D and also formulated by the following equations (1) and (2):

$$MG\text{set}=\{MG_1, MG_2, \ldots MG_M\} \quad (1)$$

$$MG_k=\{dm_k(i, j):dm_k=1 \text{ or } 0,\ i, j=1, \ldots, L,\ i\neq j\}(k=1, \ldots M) \quad (2)$$

In those equations, $MG_k$ represents (k)th mission group. Also, $dm_k(i,j)$, which takes "1" where (k)th mission bears the mission unit dm(i,j) and "0" where it bears no mission unit, is restricted by the following conditions (3) and (4):

$$1\leq M\leq N \quad (3)$$

$$\sum_{k=1}^{M} dm_k(i, j) \geq 1 \quad (4)$$

In equations, (L) represents the number of floors, and (M) represents the number of mission groups in the mission group set. For example, as shown in FIG. 4, when $dm_1$(1, 7)=1, $dm_2$(1,7)=0, $dm_3$(1,7)=0 and $dm_4$(1,7)=0, only the elevator cars allocated to the mission group 1 are serviceable to passengers who intend to be transported from the 1st hall to the 7th. Also, when $dm_1$(7,1)=1, $dm_2$(7,1)=0, $dm_3$(7,1)=0 and $dm_4$(7,1)=1, only the elevator cars allocated to mission group 1 or 4 are serviceable to passengers who intends to be transported from 1st floor to the 7th. It should be noted that in this embodiment the mission group-set generate block (5) determines $dm_k$(i,j) to maximize the traffic efficiency.

Figure 5:
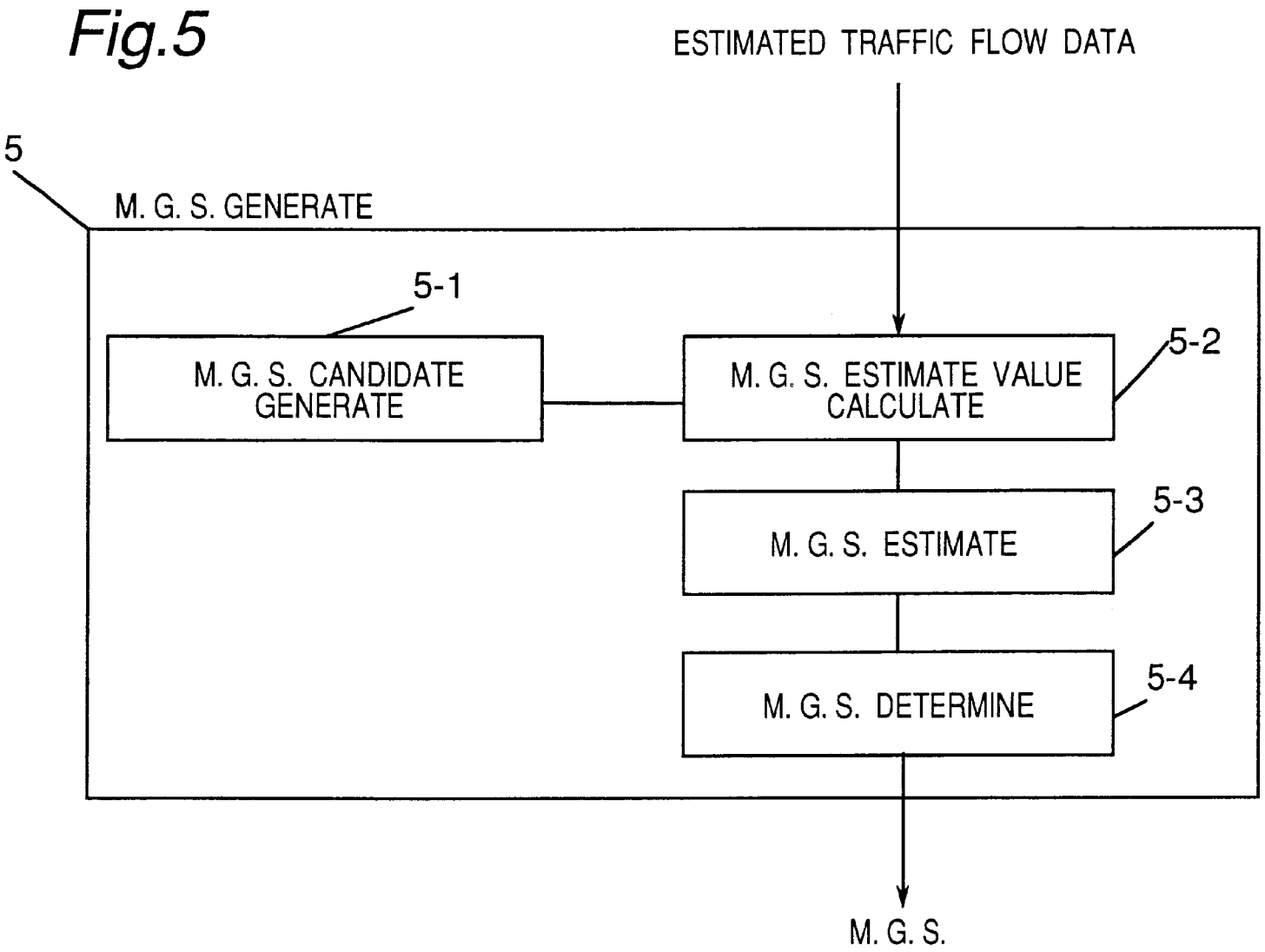
FIG. 5 is a block diagram of a mission group set generate part of the first embodiment.

Next, descriptions will be made to a process for determining respective elements of $dm_k$(i,j) in the equation (2). First, FIG. 5 shows a structure of the mission group-set generate block (5). In this block, a mission group set candidate generate part (5-1) generates mission group set candidates that meet the requirements defined by the equations (3) and (4). For example, (p)th mission group set candidate can be defined by the following equations (5) to (8):

$$MG\text{set}_p=\{MG_{p,1}, MG_{p,2}, \ldots, MG_{p,Mp}\}(p=1, \ldots, P) \quad (5)$$

$$MG_{p,k}=\{dm_{p,k}(i, j):(i, j)i, j=1, \ldots L, i\neq j\}(k=1, \ldots, M_p) \quad (6)$$

$$1\leq M\leq N \quad (7)$$

$$\sum_{k=1}^{M} dm_k(i, j) \geq 1 \quad (8)$$

Here, $MG_{p,k}$ represents the (k)th mission group in the (p)th mission group set candidate $MGset_p$. Also, $dm_{p,k}(i,j)$ represents the mission group element for the travels from the (i)th floor to the (j)th. $M_P$ represents the number of mission groups in the mission group set candidate. Furthermore, (P) represents the number of mission group set candidates.

In addition, a mission group set estimate-value calculate part (5-2) estimates an efficiency for the mission group set candidate. In this estimation, the calculate part (5-2) calculates a round-trip time RTT based upon an estimated traffic data and, in its process, estimates the load of the elevator car and the number of passengers. Then, the calculate part estimates both waiting and travel times from the calculated RTT.

It should be noted that RTT is a time required for the round-trip of the elevator car. Therefore, by averaging plural RTTs, a time interval required for the elevator car to reach respective floors, i.e., service interval of the elevator car is determined. In addition, the number of passengers to be transported per unit time can be estimated. RTT can be provided using a function of the velocity of the elevator car, the total number of floors in the building, the number of elevator cars, the number of floors where the elevators stop and time for the elevator to stop at respective floors. Note that the traffic flow and the mission group set are variable. Also, the velocity of the elevator car, the number of floors in the building and the number of elevator cars are constant values determined based upon the specifications of the building. Further, the number of floors where the elevator car stops and a time for the elevator car to stop at respective floors are given by a function of the number of passengers who use the elevator car during the round-trip the elevator. Furthermore, the passengers during the round-trip can be given by a multiplication of the arrival intervals of the passengers and the elevator. The passenger arrival interval is a function of the traffic flow data, and the elevator car arrival intervals is a function of RTT and the mission group set. Accordingly, RTT can be given as follows:

$$RTT(p, t)=f(RTT(p, t), \text{TrafficFlow}(t), MG\text{set}_p) \quad (9)$$

$$RTT(p, t)=\{rtt(p, 1, t), rtt(p, 2, t), \ldots, rtt(p, M_p, t)) \quad (10)$$

In equations, rtt(p,k,t) is an average of time in which the elevator car to which a mission group $MG_{p,k}$ is allocated makes a round-trip and thereby completes one mission group set. TrafficFlow(t), which is an estimated traffic flow data at a certain time (t), can be expressed by the OD map OD(t) and the rate of occurrence of the passenger PassRate (t) in the building as follows:

$$\text{TrafficFlow}(t)=\{OD(t), \text{PassRate}(t)\} \quad (11)$$

The OD map OD(t) is a matrix which shows the rate of travel between floors, and the rate of travel from (i)th floors to the (j)th floor is expressed as follows:

$$OD(t)=\{OD(i, j, t)|\ i=1, \ldots, L, j=1, \ldots, L\} \quad (12)$$

In this equation, OD(i,j,t) takes zero if (i) equals (j)

In this instance, RTT(p,t) takes the equation (9) and, therefore, it can be determined as a numerical solution by the repetition of the calculations.

Figure 6:
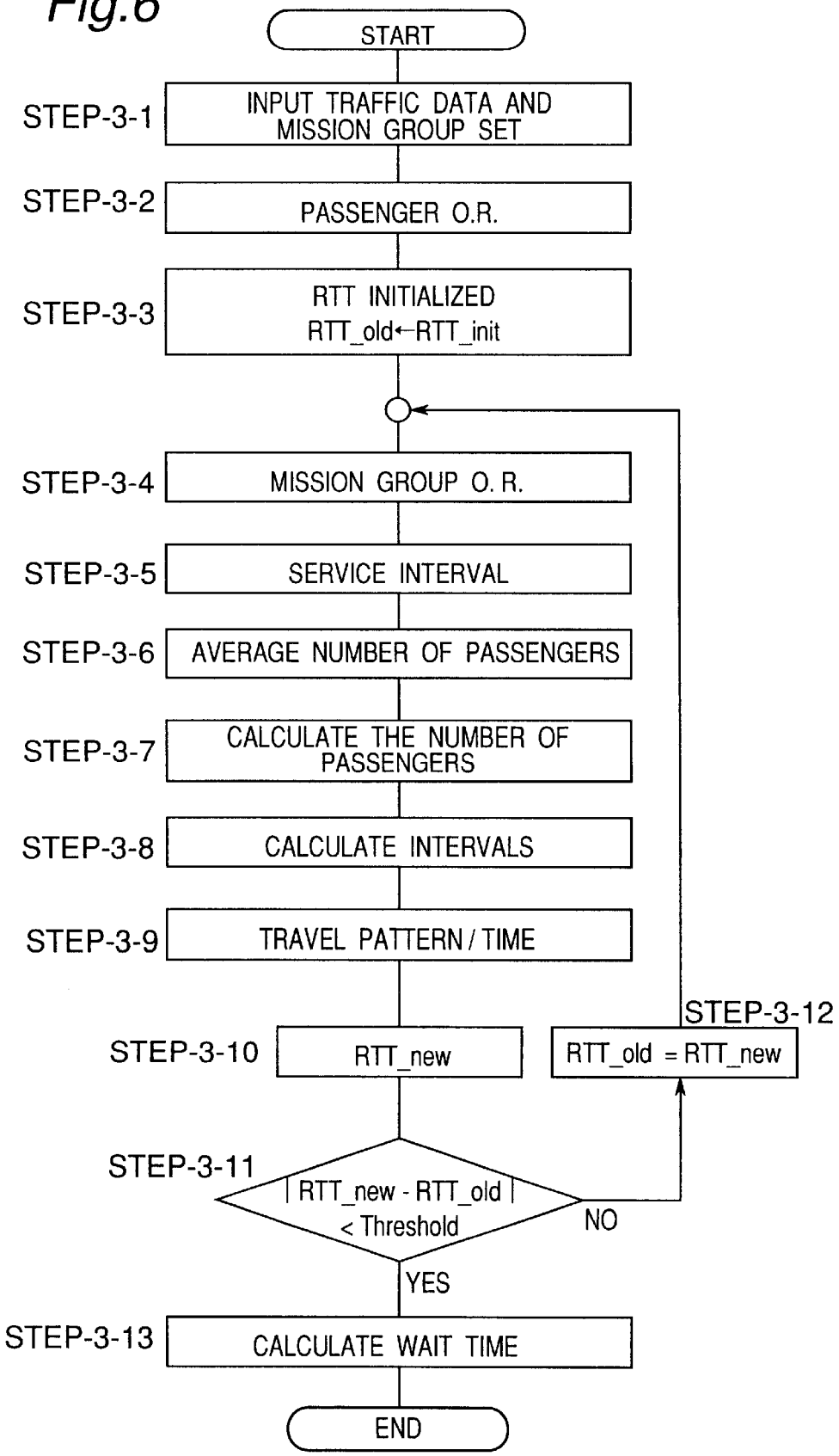
FIG. 6 is a flow chart showing a process of calculation in the mission group set estimate value calculate part.

FIG. 6 shows a flow chart of a control result estimate calculation, which will be described hereinafter. In the calculation, at step (3-1) the estimated traffic flow data TrafficFlow(t) and mission group set candidate $MGset_p$ are inputted. Then, at step (3-2) the rate of occurrence of the passenger who intends to move from the (i)th floor to the (j)th floor, PR(i,j,t) is determined from the TrafficFlow(t) using the following equation:

$$PR(i, j, t)=OD(i, j, t)\ \text{PassRate}(t) \quad (13)$$

At step (3-3) a predetermined initial value RTT-init of RTT is provided and then assigned to RTTold. Then, at step (3-4) a ratio of occurrence of each mission group is calculated. This rate is referred to as "a rate of occurrence of the mission group". The rate of occurrence of the mission group, which is a function of the total number of the passengers occurred for the whole mission groups, is given by the following equation:

$$MR_{p,k}(t) = F_{MR}\left(\sum_{i=1}^{L}\sum_{j=1}^{L} PR(i, j, t)\cdot dm_{p,k}(i, j)\right) \quad (14)$$

Assuming a model $F_{MR}$ in which the mission group is determined by the ratio of the number of passengers of the mission group to the total number of the passengers in the whole mission groups, the equation is given as follows:

$$MR_{p,k}(t) = \frac{\left(\sum_{i=1}^{L}\sum_{j=1}^{L} PR(i, j, t)\cdot dm_{p,k}(i, j)\right)}{\sum_{i=1}^{L}\sum_{j=1}^{L} PR(i, j, t)} \quad (15)$$

Then, at step (3-5) a time interval $CarArrive_p$ (i,j,t) in which the elevator car for the passenger moving from the (i)th floor to the (j)th floor would arrive is calculated from RTTold. The $CarArrive_p$ (i,j,t), which corresponds to a time interval in which the elevator car or cars having the mission group serviceable for the passengers from the (i)th floor to the (j)th floor, is given by the following equation:

$$\frac{1}{CarArrive_p(i, j, t)} = \sum_{k=1}^{M} dm_{p,k}(i, j)\frac{MR_{p,k}\cdot cNum}{\text{RTT_old}_k} \quad (16)$$

In this equation, $RTT_old_k$ is an element of RTTold, corresponding to Mission_j(i), and cNum is the number of elevator cars.

At step (3-6) an average number of the passengers which would occur at the arrival of the elevator car to which the mission group is allocated for each hall is determined. For example, when the elevator car to which the mission group $MG_{p,k}$ has been allocated reaches the (i)th hall in the upd travel, the average number of the passengers $GP_{p,k}$(i,upd,t) is determined from the following equation:

$$\begin{cases} GP_{p,k}(i, up, t) = \sum_{j=i+1}^{L} CarArrive_p(i, j, t) \cdot PR(i, j, t) \cdot dm_{p,k}(i, j) \\ GP_{p,k}(i, down, t) = \sum_{j=1}^{i-1} CarArrive_p(i, j, t) \cdot PR(i, j, t) \cdot dm_{p,k}(i, j) \end{cases} \quad (17)$$

In equations, "upd" indicates the moving direction of the elevator car and, therefore, takes "up" (upward) or "down" (downward). If upd represents upward, (i) is less than (j). On the other hand, if upd represents downward, (i) is greater than (j)th, for every floors (i), $GP_{p,k}$(i,up,t) and $GP_{p,k}$(i, down,t) are calculated, respectively.

At step (3-7), using the average number of passengers, the numbers of passengers who get on and off the elevator car and who are riding in the elevator car and a load rate of the elevator car are calculated for the upd direction, i.e., upward direction from the lowermost to uppermost floor or downward direction from the uppermost to lowermost floor, at each (i)th floor according to the following equation (18):

$$LoadRate_{p,k}(i, upd, t) = \frac{(LastLoadNum - Getoff_{p,k}(i, upd, t) + GP_{p,k}(i, upd, t))}{cNum} \quad (18)$$

In this equation, $LoadRate_{p,k}$(i,upd,t) represents the load rate, LastLoadNum represents the number of passengers loaded in the elevator car when the elevator car has passed the previous floor, and $GetOff_{pk}$(i,upd,t) represents the number of get-off passengers who has gotten off at (i)th hall in the upd travel. Note that for the upward travel LastLoadNum represents the number of passengers being loaded at (i-1)th hall while for the downward travel it represents the number of passengers being loaded at (i+1)th hall.

Getoffp,k(i,upd,t) represents the sum of passengers in the upward travel from the lowermost or (i−1)th hall to the (j)th hall or the sum of the passengers in the downward travel from the uppermost or (i+1)th halls to the (j)th hall. Also, since the number of passengers $LoadNum_{p,k}$(i,upd,t) being loaded in the elevator car when the elevator car has passed (i)th hall in the upward direction is limited to or below the number of limit for the elevator car, it is determined according to the following equation (19):

$$LoadNum_{p,k}(i, upd, t) = \min(LoadRate_{p,k}(i, upd, t), 1) \cdot CNum \quad (19)$$

In this equation, the function min(x,y) takes x or y which is smaller than the other. In addition, the number of get-on passengers at (i)th hall in the upward travel is determined from the following equation (20):

$$GetOn_{p,k}(i, upd, t) = GP_{p,k}(i, upd, t)) - \{LoadRate_{p,k}(i, upd, t) \cdot cNum - LoadNum_{p,k}(i, upd, t)) \quad (20)$$

At step (3-8), a probability of stopping at respective floors is calculated from the determined number of passengers who would get on and off the car. Actually, the elevator will stop whenever a call is made by one or more hall/car passengers. This means that the probability that is the occurrence of at least one call is considered to be identical to a probability of stopping. Assuming that the number of passengers who would get on and off the elevator car corresponds to the mean number of passengers and the passengers would occur according to a Poisson arrival typically used in the queuing theory, a probability that at least one passenger would get on or off the car during one service cycle of the elevator car is determined. Also, under the Poisson arrival, a probability of a time interval (s) in which a group of G passengers travels from (i)th floor to (j)th floor is given by the following exponential equation (21):

$$P_f(s, p, q)(t) = \frac{e^{-\frac{PR(i,j,t) \cdot s}{G}}}{PR(i, j, t)} \quad (21)$$

Then, another probability that one group would arrive at particular floor within a service cycle $CarArrive_p$(i,j,t) is given by the following equation (22):

$$P_p(i, j, t) = 1 - e^{-\frac{PR(i,j,t) \cdot CarArrive_p(i,j,t)}{G}} \quad (22)$$

Considering, among passenger group which would arrive at (i)th floor or leave from (i)th floor, the group to which the mission group (k) is serviceable, a probability StRp,k(i,upd, t) of the mission group (k) stops at (i)th floor in the upward and downward directions is given by the following equations (23):

$$\begin{cases} StR_{p,k}(i, up, t) = 1 - \prod_{x=i+1}^{L} (1 - P(i, x, t) \cdot dm_{p,k}(i, x)) \cdot \prod_{y=1}^{x-1} (1 - P(y, i, t) \cdot dm_{p,k}(y, i)) \\ StR_{p,k}(i, down, t) = 1 - \prod_{x=1}^{i-1} (1 - P(i, x, t) \cdot dm_{p,k}(i, x)) \cdot \prod_{y=x+1}^{L} (1 - P(y, i, t) \cdot dm_{p,k}(y, i)) \end{cases} \quad (23)$$

In those equations, (x) represents the destination floor for the passenger who has ridden on the elevator car travelling in the upward or downward direction, and (y) represents the origin or departure floor for the passenger who will reach the (i)th floor.

At step (3-9), based upon a probability of stop at each floor, a floor where the elevator car travelling in one direction would turn back toward the opposite direction and the number of stops in the round-trip. Then, a mean travel distance, the mean number of stops and, based on which, a time required for the round-trip is calculated. Specifically, the probability that the elevator car travelling upward would turn at the (i)th floor is identical to that the elevator car would stop at the (i)th floor and would not stop at (i+1)th or upper floors. The probability that the elevator car would not stop at (i+1)th or upper floors can be calculated recurrently based on an assumption that the possibility that the elevator car would not stop at the uppermost floor is "1". Therefore, a probability NoStRp,k(i,upd,t) that the elevator car assigned with a mission group (k) would not stop at (i)th or upper halls in the upward travel is given by the following equation (24):

$$NoStR_{p,k}(i,upd,t) = StR_{p,k}(i+1,upd,t)\}1 - StR_{p,k}(i+1,upd,t) \quad (24)$$

Also, a probability $RevR_{p,k}(i,upd,t)$ that the elevator car performing the mission group (k) and travelling upward or downward would turn at the (i)th floor is given by the following equation (25):

$$RevR_{p,k}(i,upd,t)=NoStR_{p,k}(i+1,upd,t)\cdot StR_{p,k}(i,upd,t) \tag{25}$$

From equations (24) and (25), a probability that a certain travel pattern including stopping and turnover floor or floors is determined. Then, from the number of get-on/off passengers determined at step (3-7), a time is required for the passengers to get on and off the elevator car at each floor can be calculated. Also, a time of travel for each travel pattern can be calculated. For example, a time for the particular elevator car assigned with the mission group (k) to turn downward at the (i)th floor and then turn upward at the (j)th floor is given by the following equations, respectively:

$$\begin{cases} RT(i,j,t)=\dfrac{Dis(i,j)}{v}+A_1\cdot\sum_{n=i}^{j}StR_{p,k}(n,up,t)+ \\ \qquad A_2\sum_{n=i}^{j-1}\{getOn_{p,k}(n,up,t)+getOff_{p,k}(n+1,up,t)\}(i>j) \\ RT(i,j,t)=\dfrac{Dis(i,j)}{v}+A_1\cdot\sum_{n=i}^{j}StR_{p,k}(n,down,t)+ \\ \qquad A_2\sum_{n=j+1}^{i}\{getOn_{p,k}(n,down,t)+getOff_{p,k}(n-1,down,t)\}(i>j) \end{cases} \tag{26}$$

In those equations, Dis(i,j) is a distance from the (i)th floor to the (j)th floor, (v) represents a travelling velocity of the elevator car, ($A_1$) represents a time for increasing and decreasing the velocity of the elevator car for one stop, and ($A_2$) represents a time for one passenger to get on/off the elevator car. Then, by considering the incidences for various travel patterns and then, based on which, determining the mean incidence, a time required for one mission group to be performed, $totalRT_{p,k}(t)$ is calculated from the following equation:

$$\begin{aligned} toptalRT_{p,k}(t)=&\sum_{i=1}^{M-1}\sum_{j=i+1}^{M}\{(RevR_{p,k}(i,up,t))\cdot(StR_{p,k}(i,up,t))\} \\ &\{(RevR_{p,k}(j,up,t))\cdot(StR_{p,k}(j,up,t))\}RT(i,j,t)+ \\ &\sum_{i=2}^{M}\sum_{j=1}^{i-1}\{(RevR_{p,k}(i,up,t))\cdot(StR_{p,k}(i,up,t))\} \\ &\{(RevR_{p,k}(j,down,t))\cdot(StR_{p,k}(j,down,t))\}RT(i,j,t) \end{aligned} \tag{27}$$

At step (3-10), the round-trip time calculated at step (3-9) is substituted for RTTnew as a new RTT.

At step (3-11), RTTnew is compared with old RTTold. If the difference between RTTnew and RTTold is less than a predetermined threshold value, then the program proceeds to step (3-13). Otherwise, the program proceeds to step (3-12) where the RTTold is replaced by RTTnew and then returns to step (3-5). At step (3-13), from the service cycle CarArrivep(i,j,t) for the passengers, the wait time is calculated. In addition, the travel time is calculated from the stopping possibilities for respective halls.

According to the above processes, the mean wait time, mean travel time, the car loading rate and the number of passengers who would get on and off at the particular floor are obtained as a control result estimate value.

Then, discussions will be made to the estimate value calculation performed at mission group set estimate part (5-3). As described above, at the real time simulator the mean wait time, the mean travel time, the loading rate of elevator car and so forth are obtained as the control is result estimate value. Therefore, if the mission group set candidate MGsetp is selected for a estimated traffic flow TrafficFlow(t), a corresponding evaluating value is given as follows:

If(MaxLoad($p$, $t$)<LoadThreshold $$E(p,t)=K1\cdot\text{WaitTime}(p,t)+K2\cdot\text{TravelTime}(p,t) \tag{28}$$

Else $$E(p,t)=\infty$$

In those equations, Maxload(p,t) is the maximum value of LoadRate(k,i,upd) calculated from the estimate traffic flow TrafficFlow(t) and the mission group set candidate $MGset_p$. LoadThreshold is a limit load for the elevator car. If the LoadThreshold is not less than "1", one or more left-off passengers would occur. E(p,t) is an estimate value of the mission group set candidate $MGset_p$. WaitTime(p,t) is the mean wait time for the elevator system in the building when the mission group set candidate $MGset_p$ is selected. TravelTime(p,t) is the mean travel time for the elevator system. K1 and K2 are weights for wait and travel times, respectively.

When the estimate value E(p,t) is defined as described above, a mission group set determine part (5-4) selects the mission group set candidate MGsetp that minimizes E(p,t) for a mission group set MGset which is then stored in the mission group set memory (6). The mission group set memory (6) memorizes the input mission group set MGset. The above processes are performed at the renewal of the trafficFlow(t).

Then, when a new hall call $Call_{new}$ is made, the mission group select block (7) selects, from the mission group set MGset, the mission group MGk that is available for the hall call. Alternatively, a plurality of mission groups may be selected, if serviceable. In this instance, if no elevator car exists for which the mission group set has been allocated, the mission group allocate block (8) allocates any mission group MG, to the elevator cars, according to an allocation rule.

In this allocation rule, the number of elevator cars to which no mission group is allocated is determined. Then, if the number is "1", the mission group is allocated to the car. If the number is more than "1", the mission group is allocated to the elevator car that can respond to the latest hall call in first. If on the other hand the number is "0", the mission group is allocated to the elevator car that will complete the currently allocated mission group in first.

A mission group select block (7) determines whether there exists any elevator car to which the mission group MGk is now being allocated. Then, a mission group allocate block (8) allocates the mission group MGk to the elevator car and then determines the elevator car or cars that can be available to the new hall call $Call_{new}$. Then, the call allocate block (9) determines the elevator car to which the new call is allocated. Specifically, if the mission group selected at the mission group select block (7) is one, the elevator car to which the mission group MG, has been allocated is selected. If two or more mission groups have been selected at the mission group select block (7), among them the elevator car that can be available to the latest new call $Call_{new}$ is selected most quickly. Alternatively, it is possible to estimate other factors such as times for responding to the call and for completing the service for respective calls generated and then select the elevator car to which the best estimation has been provided.

As described above, by so constructing the optimal elevator control system, the optimal mission group set is determined to every traffic flow, TrafficFlow(t) Also, by controlling the elevator cars at the elevator control block (7) according to the optimal mission group set, an optimal elevator car control can be attained, which provides more simplified and less time-consuming calculation of the call allocation.

Second Embodiment

Figure 7:
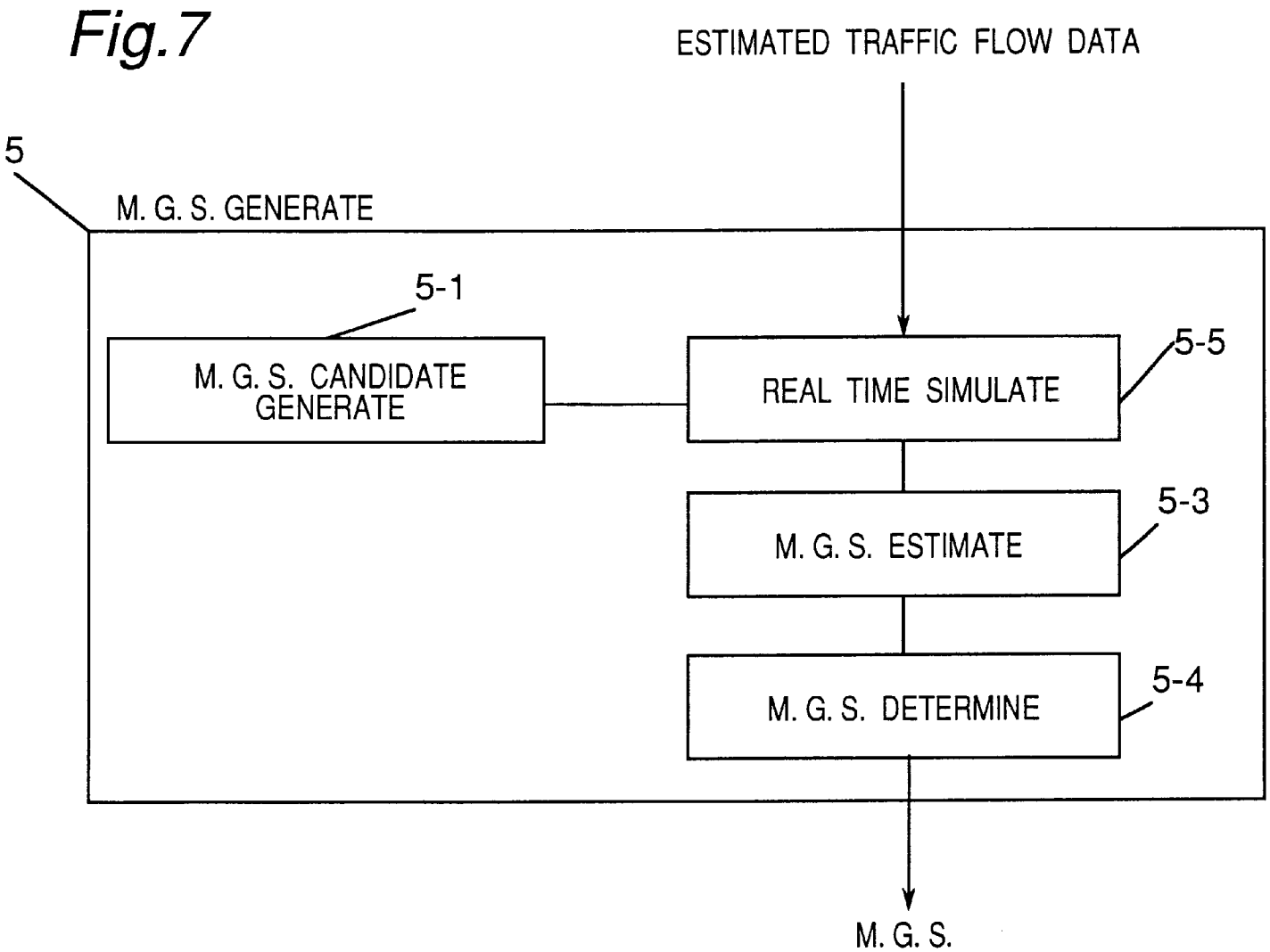
FIG. 7 is a block diagram of a mission group set generate part of a second embodiment.

Another embodiment of the optimal elevator control method and system for elevator cars will be described hereinafter. In this embodiment, as shown in FIG. 7, a real time simulate part (5-5) is provided instead of the mission group set estimate-value calculate part (5-2). Others are the same as those in the first embodiment and therefore no detailed description will be made thereto. Specifically, FIG. 7 shows the mission group set generate block (5) for the second embodiment. In this block, the real time simulate part (5-5) estimates the traffic efficiency of mission group set candidate using an optimal control method simulator for the group of elevator cars. The simulator receives an input of the mission group set candidate and then provides an output of the wait and travel times. For this purpose, the simulator is equipped with several functions equivalent to those of mission group select block (7), mission group allocate block (8) and call allocate block (9) for a call allocation algorithm, as shown in FIG. 8.

Figure 8:
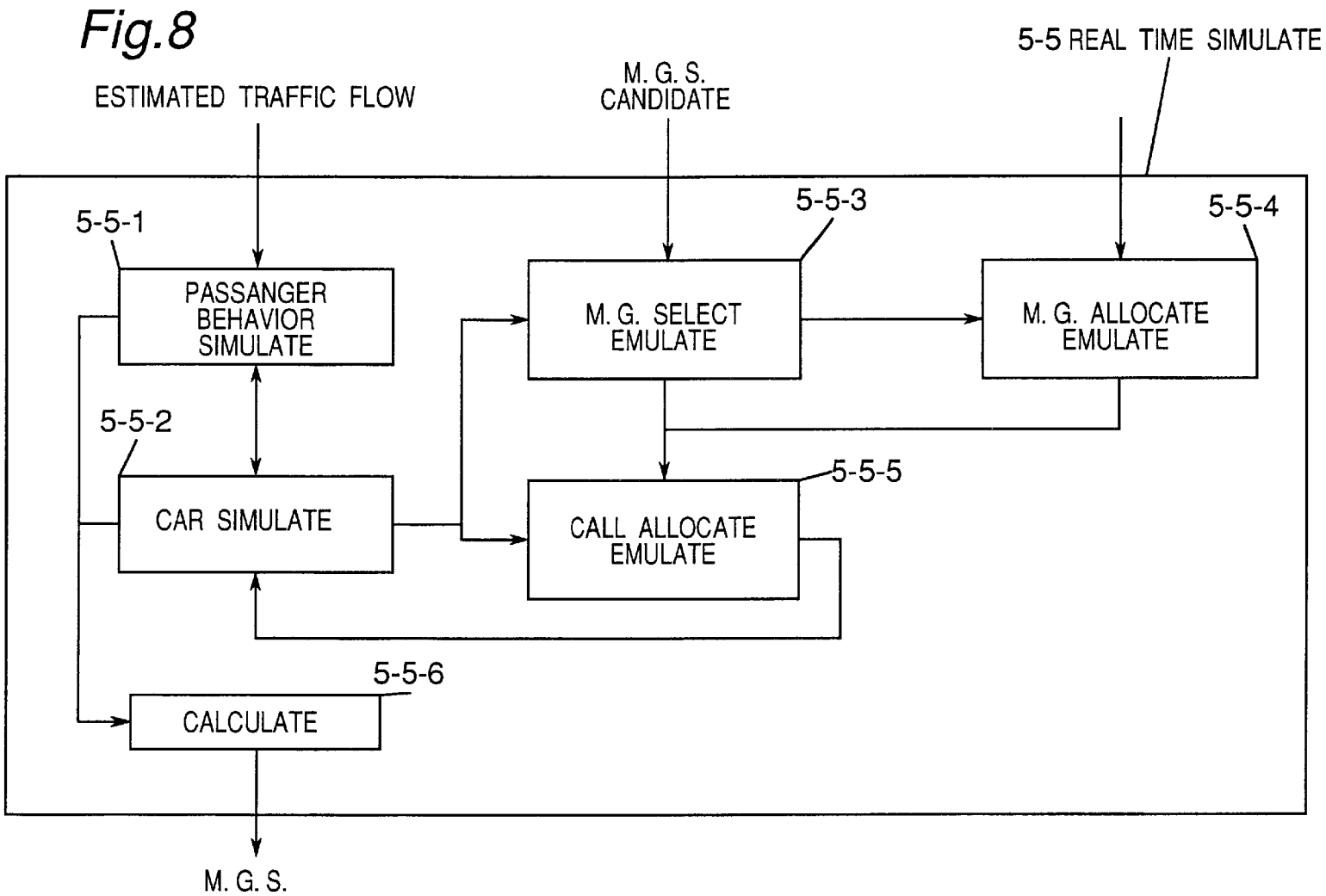
FIG. 8 is a block diagram of a real time simulator of the second embodiment.

In FIG. 8, a passenger behavior simulate part (5-5-1) simulates an entire process from the call generation by the passenger to the completion of the transportation of the passenger according to the estimated traffic flow. An elevator car travel simulate part (5-5-2) simulates the motions for the elevator cars including stopping operations of the elevator cars and conditions of the doors. A mission group select function emulation part (5-5-3) has the same function as the mission group select block (7). Also, a mission group allocate function emulation part (5-5-4) has the same function as the mission group allocate block (8). Further, a call allocation function emulation part (5-5-5) has the same function as the call allocate block (9). A group control result calculate part (5-5-6) calculates a group control result such as wait and travel times based upon the simulation results made by both the passenger movement simulate part (5-5-1) and the elevator car simulate part (5-5-2).

By so constructing the optimal control method and system for the elevator cars, it is possible to estimate the mission group set candidate more precisely. This allows more optimal mission group set to be selected for the traffic flow. Also, by controlling the traffic according to the optimal mission group set, the elevator cars can be controlled properly and the call allocate calculation can be done more easily and rapidly.

Third Embodiment

Discussions will be made to a third embodiment of the optimal elevator control method and system, which is different from the above described embodiments 1 and 2. The system of this embodiment further includes a mission group set database in which a relationship between the mission group set and the estimated traffic flow data is stored.

Figure 9:
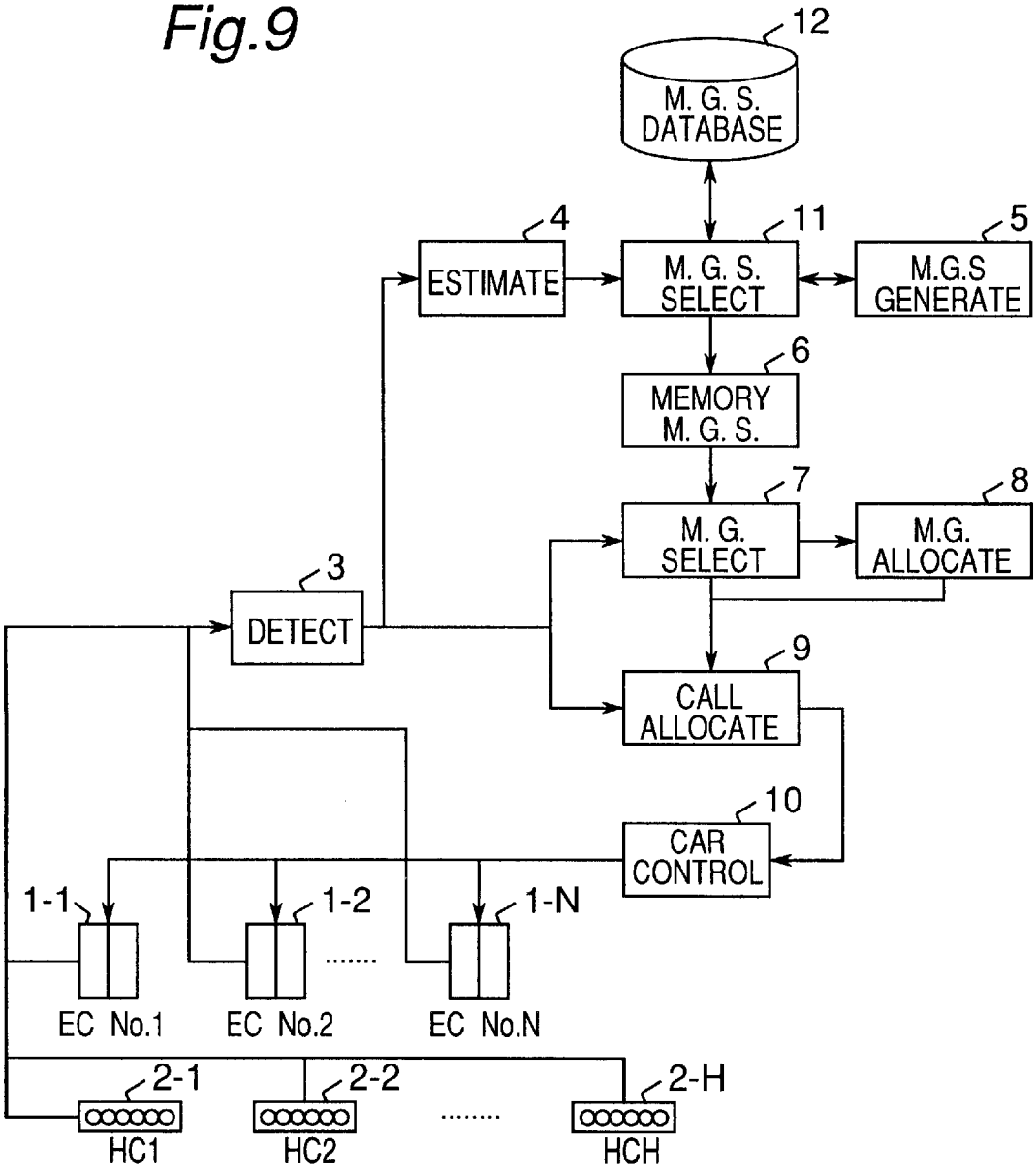
FIG. 9 is an optimal control system of a third embodiment according to the present invention.

FIG. 9 shows a schematic view of this embodiment in which a mission group set select block (11) and a mission group set database (12) are added. The remaining features of this embodiment are the same as the first and second embodiments and, therefore, no detail descriptions will be made thereto. Specifically, the mission group set database (12) stores following data:

$$data_q=\{TraficFlow_q, MGset_q\}(q=1, \ldots, Q) \tag{29}$$

In this equation, $data_q$ is a (q)th stored data. Q is the number of stored data. $TrafficFlow_q$ is a (q)th stored traffic flow. $MGset_q$ is an optimal mission group set for the $TrafficFlow_q$. Using the database, the mission group set MGset is determined for the estimated traffic flow TrafficFlow(t) as described below.

Specifically, when the estimated traffic flow TrafficFlow(t) is transmitted from the traffic flow estimate block (4) into the mission group set select block (11), a search is made to find $data_q$ having $TrafficFlow_q$ identical to the estimated traffic flow data TrafficFlow(t) in the stored data in the mission group set database 12. If there exists the $data_q$, the mission group set $MGset_q$ is transmitted to the mission group set memory block (6) as the mission group set MGset, based on which the optimal elevator control is performed. Otherwise, similar to the embodiments 1 and 2, the mission group set generate block (5) generates the mission group set MGset. At this moment, in addition to that the mission group set MGset is transmitted to the mission group set memory block (6) to perform the optimal, TrafficFlow(t) and MGset are stored as new data in the mission group set database (12) in the form of following equation:

$$data_{(Q+1)}=\{TrafficFlow_{(Q+1)}=TrafficFlow(t), MGset_{(Q+1)}=MGset\} \tag{30}$$

According to the optimal control method and system so constructed, the mission group set can be selected more quickly than the other embodiments. Also, by controlling the traffic at the elevator traffic control block (7) according to the optimal mission group set, the elevator cars can be controlled properly and the call allocate calculation can be done more easily and rapidly.

Fourth Embodiment

Another embodiment, which is different from the third embodiment to some extent, for the optimal elevator control method and system will be described below. According to this embodiment, instead of mission group select block (11) and mission group set database (12) in the third embodiment, a neuro-mission group set select block which uses a neurological network for the selection of the mission group set is introduced therein.

Figure 10:
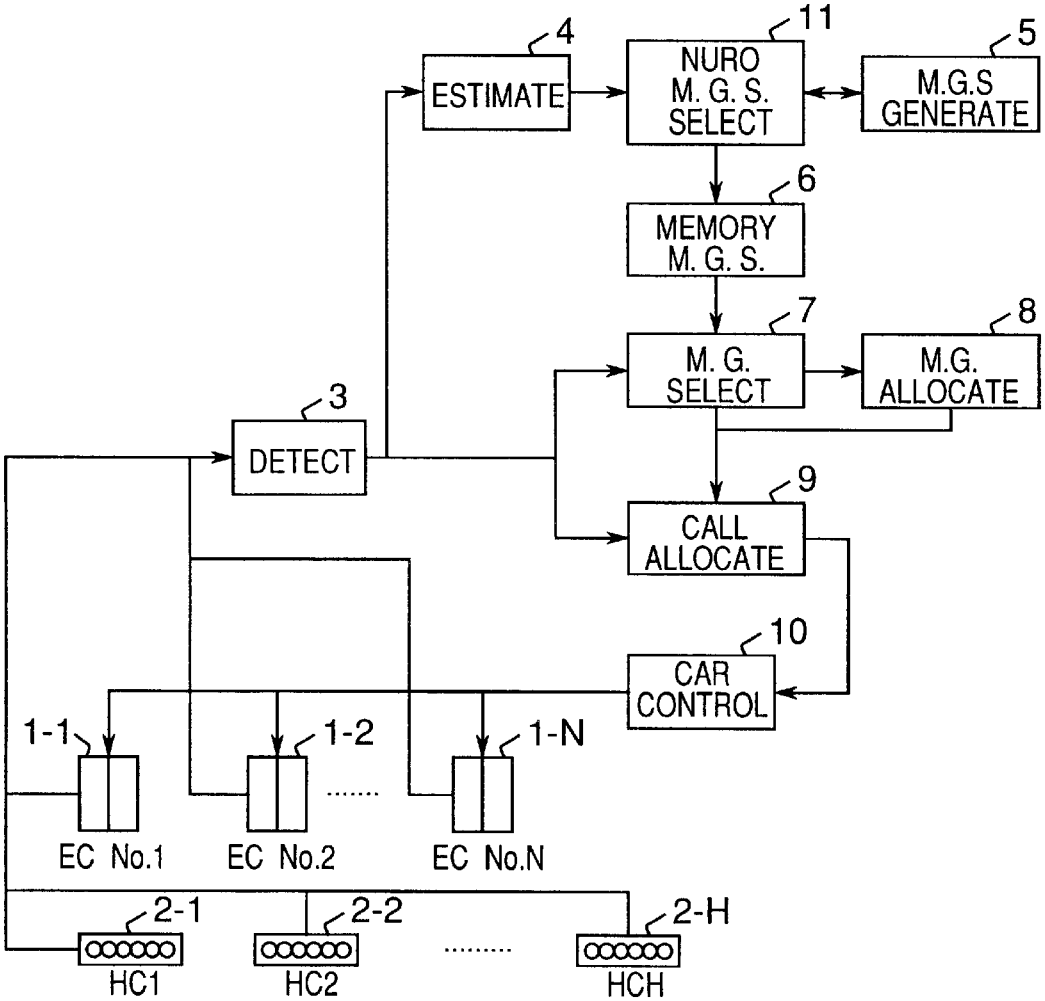
FIG. 10 is an optimal control system of a fourth embodiment according to the present invention.
Figure 11:
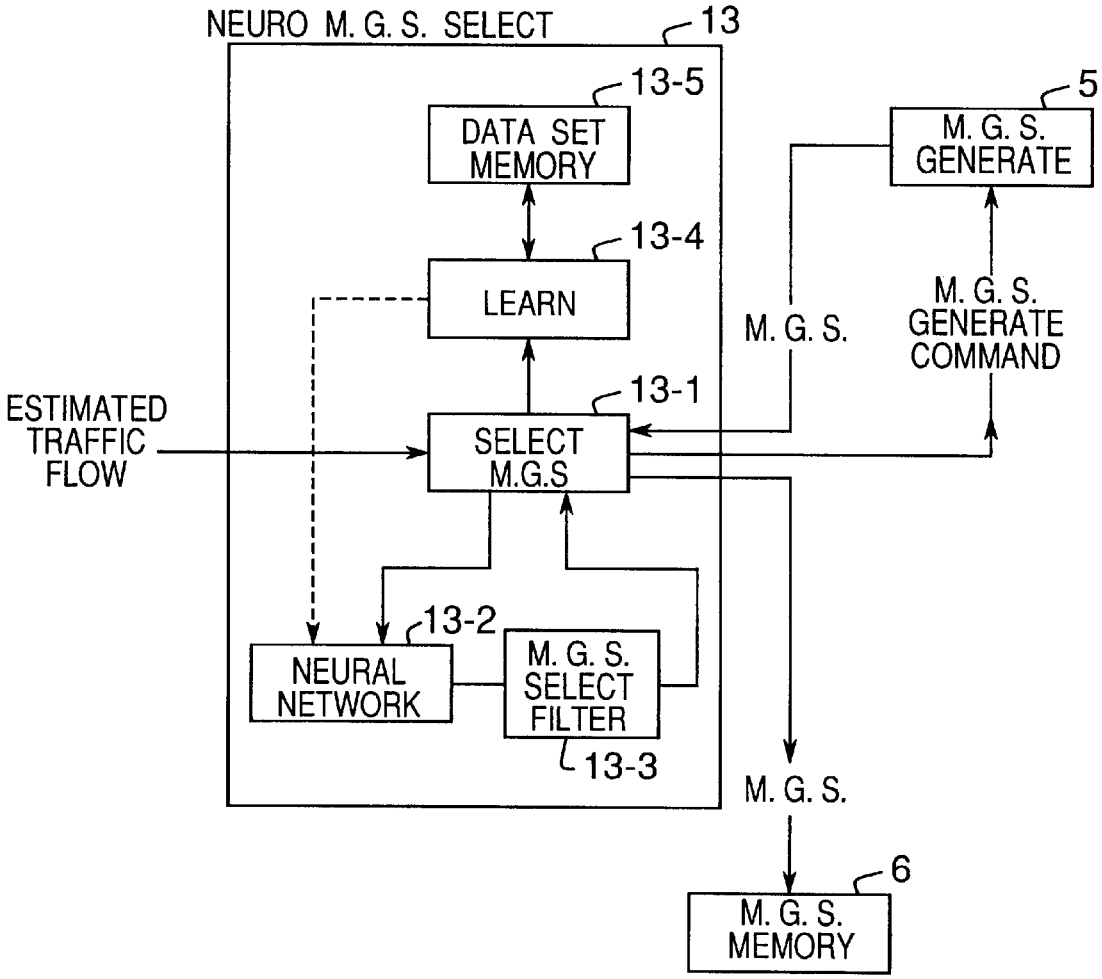
FIG. 11 is a block diagram of a neuro mission group set select part of the fourth embodiment of the present invention.
Figure 12:
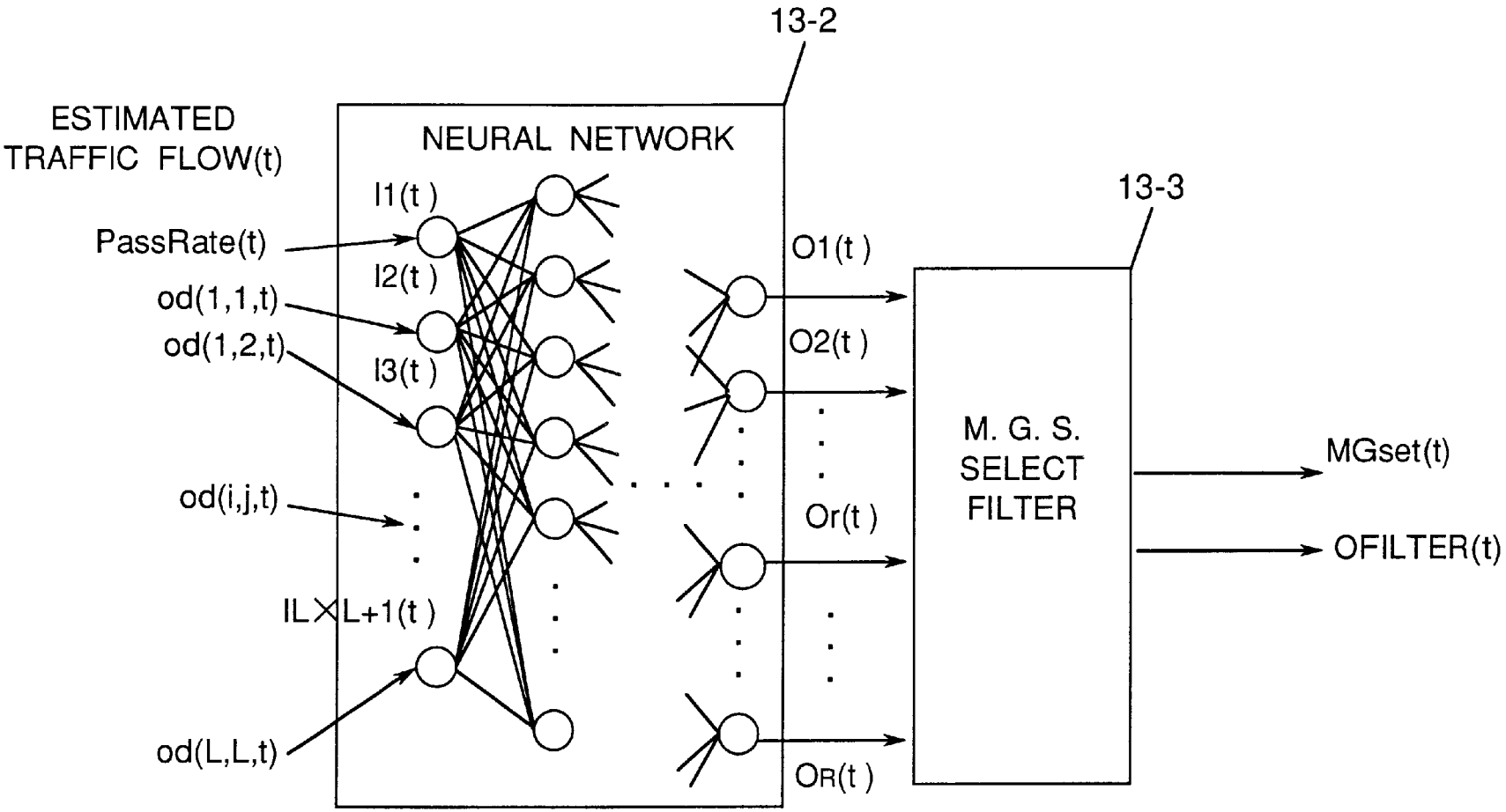
FIG. 12 is a block diagram of a neural network and a mission group set select part according to the fourth embodiment of the present invention.

FIG. 10 shows a schematic block diagram of this embodiment. As can be seen from the drawing, this embodiment is similar to the third embodiment except for a neuro-mission group set select block (13). The neuro-mission group set select block (13) is a neural network in which a relationship between the estimated traffic flow data TrafficFlow(t) and the mission group set MGset is learned. FIG. 11 shows a structure of the neural network. As can be seen from this drawing, when the estimated traffic flow is transmitted to the neuro-mission group set select block (13), a neuro-mission group select part (13-1) transmits the data to the neural network (13-2). The neural network (13-2) having a structure shown in FIG. 12 transmits each element of the estimated traffic flow data TrafficFlow(t) to an input layer neuron. For example, in FIG. 12, $o_r(t)$ represents an output from an (r)th output neuron in the neural network (13-2) for the input data TrafficFlow(t) at time (t), and (R) represents the number of mission group set $MGset_r$, i.e., the number of output layer neurons, learned in the neural network (13-2). Also, a group of learned mission group set is given by the following equation:

$$LMG\text{set}=\{MG\text{set}_r : r=1, \ldots, R\} \tag{31}$$

The neural network is learned so that the output layer neuron corresponding to the optimal mission group set $MGset_y$ outputs $o_y(t)=1$ or $o_r(t)=0$ according to the input $TrafficFlow_y$. The output is then transmitted to a mission group set select filter (13-3). The filter (13-3) processes the output of the neural network by the use of a threshold filter indicated by the following equations:

$$\begin{cases} F_r(t) = 1 & (o_r(t) \geq TH) \\ F_r(t) = 0 & (o_r(t) < TH) \end{cases} \tag{32}$$

In those equations, Fr(t) is the threshold filter for $o_r(t)$. At this moment, a value of the mission group set select filter is determined from a specific rule given by the following equations:

$$\begin{cases} \text{if } \left(\sum_{r=1}^{R} F_r = 0\right) \text{ then } FileterO(t) = noMGset \\ \quad \text{else if } \left(\sum_{r=1}^{R} F_r > 1\right) \text{ then} \\ \quad \begin{cases} FileterO(t) = pluralSelection \\ O_{FILTER}(t) = \{F_r(t) : r = 1, \ldots, R\} \end{cases} \\ \text{else } \text{FileterO}(t) = \sum_{r=1}^{R} (F_r(t) \cdot r) \end{cases} \tag{33}$$

In those equations, Filter0(t) is an output of the threshold filter at time (t), the value of which being represented by both (p) and $MGset_p$ for the mission group set candidate candidate. "noMGset" represents that no corresponding mission group candidate exists. "pluralSelection" represents that a plurality of corresponding mission group candidates exist. "$\mathbf{0}_{FILTER}(t)$" represents a mass of filter outputs. Filter0 (t) and $\mathbf{0}_{FILTER}(t)$ are provided to the neuro-mission group set select control part (13-1). The part (13-1) outputs MGset-Filter0 (t) to the mission group set memory block as mission group set MGset when Filter0(t) is not identical to noMGset and then completes the selection process of the mission group set. When Filter0(t) is identical to noMGset, the estimated traffic flow data TrafficFlow(t) is transmitted to the mission group set generate block (5). The mission group set generate block (5) generates the optimal mission group set MGset for the estimated traffic flow data TrafficFlow(t) and provides the MGset to the neuro-mission group set select control part (13-1). The neuro-mission group set select control part (13-1) outputs the mission group set MGset to the mission group set memory block (6) and then provides the neural network learning part (13-4) with TrafficFlow(t) and mission group MGset as new leaning data newLdata(t) defined as follows:

$$\text{new}L\text{data}(t)=\{\text{TrafficFlow}(t), MG\text{set}\} \tag{34}$$

The neural network leaning part (13-4) adds the new learing data newLdata(t) to the learning data set LData stored in the learning data set memory part (13-5). The learning data set LData is given by the following equation:

$$L\text{Data}=\{L\text{data}_1, L\text{data}_2, \ldots, L\text{Data}_y\} \tag{35}$$

$$L\text{data}_y=\{\text{TrafficFlow}_y, MG\text{set}_y\} \tag{36}$$

In these equations, "Y" represents the number of learning data stored in the learning data set memory part (13-5). "$Ldata_y$" is (y)th learning data including the traffic flow data $TrafficFlow_y$ and the corresponding, optimal mission group set $MGset_y$. When the learned mission group set $MGset_r$ identical to MGset in the newLdata(t) is not included in the mass of learned mission group set LMGset, the neural network learning part (13-4) increases the number of output layer neurons in the neural network 13-2 by one. Then, the neural network (13-2) learns the relationship between the traffic flow data $TrafficFlow_y$ and the mission group set $MGset_y$.

According to the optimal control method and system, the mission group set can be selected more rapidly with a smaller memory. Also, by controlling elevator cars using the elevator control 7 according to the optimal mission group set, the optimal traffic flow of the elevator cars can be attained and the calculation for the allocation of the calls can be done more easily and rapidly.

In conclusion, according to the optimal control method and apparatus of the present invention, the elevator cars are optimally controlled for the traffic flow. Also, the calculation of the call allocation can be performed readily and rapidly.

Also, with the arrangement of the real time simulator, the calculation can be performed more readily and rapidly.

Further, with another arrangement of the database that stores the relationship between the mission group sets and the estimated traffic flows, the optimal mission group set can be determined rapidly.

Furthermore, with another arrangement of the neural network that learns the relationship between the mission group set and the estimated traffic flows, the optimal mission group set can be determined with less time and smaller computer.

What is claimed is:

1. A method of controlling a group of elevator cars serving a plurality of floors in a building, comprising:

(a) defining a matrix of all possible origin (departure) floors and all possible destination floors for travel in the building by elevator passengers, each element in the matrix representing a unique travel path between a combination of one of the origin floors and one of the destination floors and having a value indicating a ratio of passengers traveling along the corresponding travel path to total passengers traveling on the group of elevator cars, and being a mission unit;

(b) defining a plurality of mission groups, each mission group having at least one mission unit and being serviceable by one of the elevator cars of the group of elevator cars;

(c) defining a mission group set, the mission group set being a plurality of the mission groups provided for the group of elevator cars; and (d) dynamically allocating the mission group to the group of elevator cars.

2. The method of claim 1, further comprising (e) estimating a current traffic flow, wherein (c) generates the mission group set optimal for the current traffic flow estimated, and (d) dynamically allocates the mission groups in the mission group set optimal for the current traffic flow estimated to the group of elevator cars.

3. The method of claim 1, further comprising (e) estimating a current traffic flow, wherein (c) evaluates the current traffic flow estimated and then determines the mission group set optimal for the current traffic flow estimated, and (d) dynamically allocates the mission groups in the mission group set optimal for the current traffic flow estimated to the group of elevator cars.

4. The method of claim 1, further comprising:

(e) estimating a current traffic flow, and (f) evaluating the mission group set for the current traffic flow estimated in a real time simulation, wherein (d) dynamically allocates the mission groups in the mission group set optimal for the current traffic flow estimated to the group of elevator cars.

5. The method of claim 1, further comprising:

(e) estimating a traffic flow, and (f) storing a relationship between the traffic flow estimated and the mission group defined for the traffic flow wherein (c) determines the mission group set optimal for the traffic flow estimated, and (d) dynamically allocates the mission groups in the mission group set optimal for the traffic flow estimated to the group of elevator cars.

6. The method of claim 1, further comprising (e) learning a relationship between a traffic flow and the mission group in a neural network wherein (c) determines the mission group set optimal from the relationship learned in said neural network, and (d) dynamically allocates the mission groups in the mission group set optimal for the relationship to the group of elevator cars.

7. A control system for a group of elevator cars serving a plurality of floors in a building and a plurality of hall devices producing hall calls requesting travel between the floors in the building, said system comprising:

a detector that detects conditions of said group of elevator cars and said hall devices;

a traffic estimator that estimates a traffic flow from the conditions detected by said detector and provides a matrix of all possible origin (departure) floors and all possible destination floors for travel in the building by passengers, each element in the matrix representing a unique travel path between a combination of one of the origin floors and one of the destination floors and having a value indicating a ratio of passengers traveling along the corresponding travel path to total passengers traveling on the group of elevator cars, and being a mission unit, the mission units forming a plurality of mission groups, each mission group including at least one mission unit that is serviceable by one of the elevators cars of the group of elevator cars, the mission groups being organized into mission group sets;

a mission group set candidate generator that defines a plurality of mission group set candidates, each of the mission group set candidates having a plurality of mission group sets;

a calculator that calculates evaluation values for the mission group set candidates based on the traffic flow estimated;

an evaluator that makes an evaluation of the mission group set candidates based on the evaluation values;

a mission group set determine part that determines an optimal mission group set from the mission group set candidates based on the evaluation;

a mission group set memory that memorizes the optimal mission group set determined;

a mission group selector that selects the mission groups suitable for the conditions of the elevator cars of the group of elevator cars;

a mission group allocator that allocates the mission groups selected as suitable for the group of elevator cars;

a call allocator that allocates hall calls to the group of elevator cars based on the mission groups; and a controller that controls the group of elevator cars in response to the hall calls allocated to the group of elevator cars.

8. The system of claim 7, wherein said calculator includes a real time simulator that calculates the evaluation values for the mission group set candidates based on the estimated traffic flow.

9. The system of claim 7, further comprising a database that stores mission group sets, and said mission group set determine part has a mission group set selector that determines the mission group set based on the stored mission group sets.

10. The system of claim 7, wherein said mission group set determine part has a mission group set selector that selects the mission group set using a neural network designed to learn a relationship between the traffic flow estimated and the optimal mission group for the traffic flow estimated.

* * * * *